US009624794B2

(12) United States Patent
Shewell

(10) Patent No.: US 9,624,794 B2
(45) Date of Patent: Apr. 18, 2017

(54) HYDRAULIC LASH ADJUSTER ANTI-ROTATION CLIP

(71) Applicant: Schaeffler Technologies AG & Co. KG, Herzogenaurach (DE)

(72) Inventor: Jeffrey Shewell, Rochester, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/799,983

(22) Filed: Jul. 15, 2015

(65) Prior Publication Data

US 2016/0040563 A1 Feb. 11, 2016

Related U.S. Application Data

(60) Provisional application No. 62/033,829, filed on Aug. 6, 2014.

(51) Int. Cl.
*F01L 1/18* (2006.01)
*F01L 1/24* (2006.01)

(52) U.S. Cl.
CPC ..... *F01L 1/2405* (2013.01)

(58) Field of Classification Search
CPC ..... F01L 1/2405
USPC ..... 123/90.52
See application file for complete search history.

(56) References Cited

U.S. PATENT DOCUMENTS 5,875,602 A * 3/1999 Lappin ..... E04F 13/0864 24/338
8,151,752 B2 4/2012 Hendriksma
2011/0011361 A1* 1/2011 Roberts ..... F01L 1/185 123/90.55

FOREIGN PATENT DOCUMENTS

DE 19602013 A1 7/1997
DE 10055595 A1 5/2002

* cited by examiner

*Primary Examiner* — Zelalem Eshete
(74) *Attorney, Agent, or Firm* — Volpe and Koenig, P.C.

(57) ABSTRACT

A hydraulic lash adjuster arrangement is provided that includes a cylinder head including a bore and at least one hydraulic fluid gallery. The hydraulic lash adjuster arrangement includes a hydraulic lash adjuster assembly including a housing positioned in the bore of the cylinder head and including an annular body that includes a port on a radially outer wall of the housing. A plunger is arranged within the annular body of the housing and is axially displaceable therein. A clip including a circular body is arranged radially between the housing and the cylinder head. The clip includes at least one first tab extending radially outwardly that engages the at least one hydraulic fluid gallery and at least one second tab extending radially inwardly that engages the port.

19 Claims, 1 Drawing Sheet

HYDRAULIC LASH ADJUSTER ANTI-ROTATION CLIP

INCORPORATION BY REFERENCE

The following documents are incorporated herein by reference as if fully set forth: U.S. Provisional Patent Application No. 62/033,829, filed Aug. 6, 2014.

FIELD OF INVENTION

The present invention relates to a clip for use in a hydraulic lash adjuster arrangement.

BACKGROUND

Hydraulic lash adjusters are used in valve trains of internal combustion engines to accommodate valve lash, as well as, in certain applications, to control valve lift modes. Internal combustion engines include cylinder heads in which the lash adjusters are typically arranged which have hydraulic fluid galleries that feed pressurized hydraulic fluid to ports defined in a housing of the hydraulic lash adjuster. A plunger is arranged within a bore of the housing and is axially displaceable to perform the hydraulic lash adjustment as well as optionally a switching function to provide a partial or zero lift opening of the associated valve. When the switching function is provided, a port of the housing feeds hydraulic fluid into a chamber of the plunger which directs the hydraulic fluid to an open-ended nose portion and actuates a switching function of the rocker arm or finger lever assembly between first and second valve lift modes.

A significant amount of pressure loss occurs when the hydraulic fluid flows from the hydraulic fluid gallery of the cylinder head to a space defined between the cylinder head and an outer surface of the outer housing. Pressure loss is particularly high when the port of the housing is not aligned with the hydraulic fluid gallery in the cylinder head. One way to ensure that hydraulic fluid is quickly fed to the port on the housing is to provide a number of ports around a periphery of the housing. However, modifying the housing with multiple ports increases the costs and time required for assembly and formation, as well as reduces the strength of the housing. It is desirable to minimize the amount of time required to perform the switching function and to minimize the pressure loss when hydraulic fluid travels from the cylinder head gallery to the ports on the outer housing of the adjuster without compromising the strength of the housing or requiring a complex formation process.

SUMMARY

Briefly stated, a hydraulic lash adjuster arrangement including a clip for preventing rotation of a housing within a bore of a cylinder head is provided. The hydraulic lash adjuster arrangement includes a cylinder head including a bore and at least one hydraulic fluid gallery. The hydraulic lash adjuster arrangement includes a hydraulic lash adjuster assembly including a housing positioned in the bore of the cylinder head formed by an annular body that includes a port on a radially outer wall of the housing. A plunger is arranged within the annular body of the housing and is axially displaceable therein. A clip including a circular body is arranged radially between the housing and the cylinder head. The clip includes at least one first tab extending radially outwardly that engages the at least one hydraulic fluid gallery and at least one second tab extending radially inwardly that engages the port. The clip prevents the housing from rotating within the cylindrical bore of the cylinder head, and, once installed, maintains alignment between the hydraulic fluid gallery of the cylinder head and the port of the housing.

In another embodiment, a hydraulic lash adjuster assembly is provided that includes a housing having an annular body and a port on a radially outer wall of the housing. A plunger is arranged within the housing and is axially displaceable therein. A clip including a circular body is arranged annularly around the housing and includes at least one first tab extending radially outwardly that is adapted to engage at least one hydraulic fluid gallery formed in a cylinder head, and at least one second tab extending radially inwardly that engages the port.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 2:
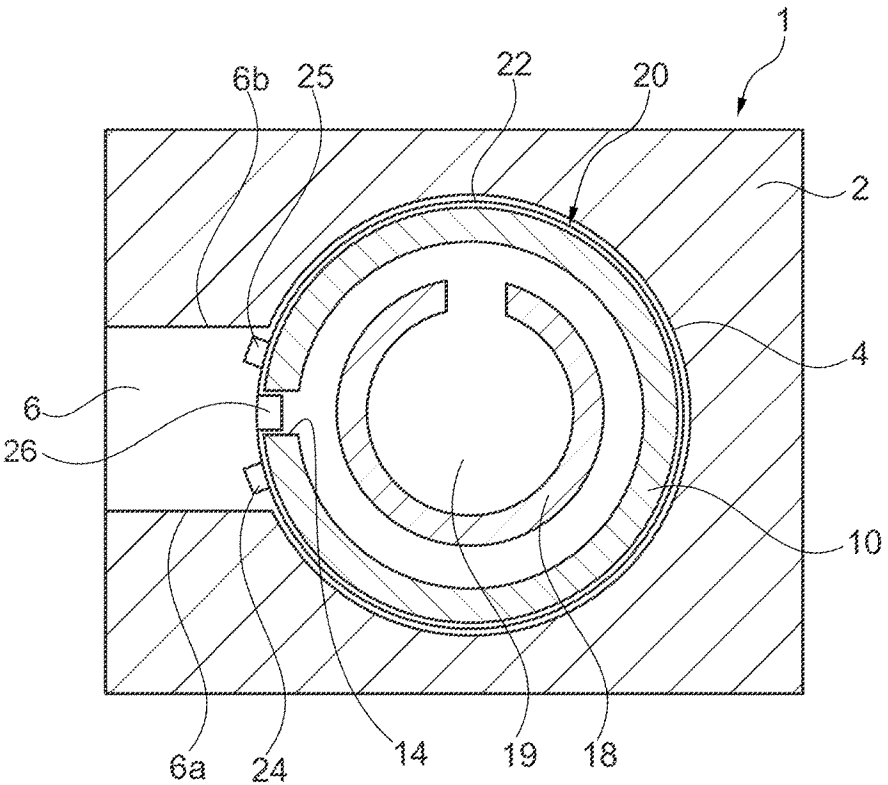
FIG. 2 is a cross-sectional view along line II-II in FIG. 1.

Certain terminology is used in the following description for convenience only and is not limiting. The words "front," "rear," "upper," and "lower" designate directions in the drawings to which reference is made. The words "inwardly" and "outwardly" refer to directions toward and away from the parts referenced in the drawings. "Axially" refers to a direction along the axis of a shaft or rotating part. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 1:
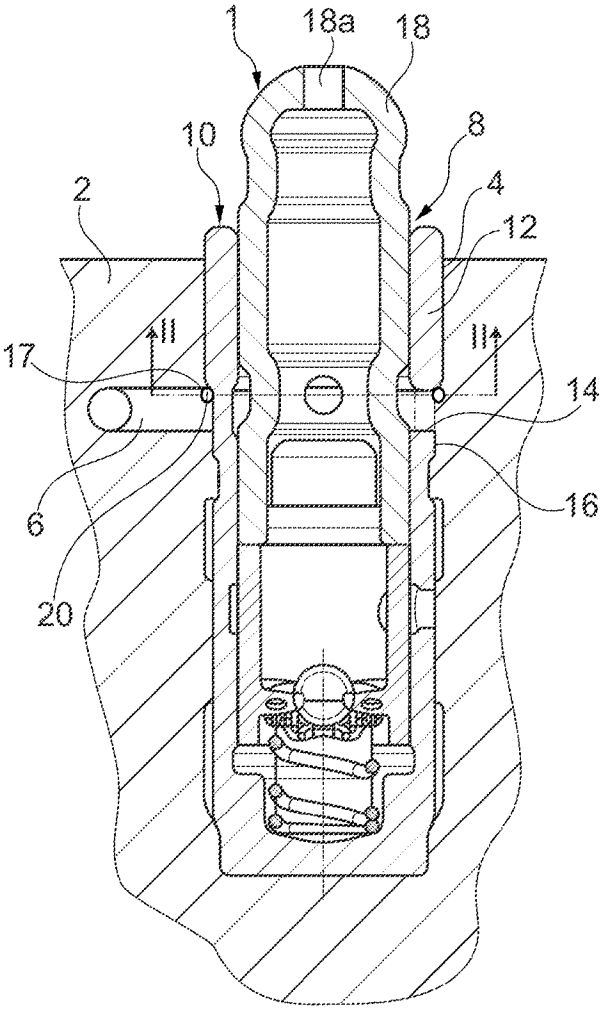
FIG. 1 is cross-sectional view through a hydraulic lash adjuster arrangement in accordance with the present invention.

Referring to FIG. 1, a cross-sectional view through a hydraulic lash adjuster arrangement 1 having a clip 20 according to an exemplary embodiment is shown. The hydraulic lash adjuster arrangement 1 includes a cylinder head 2 including a bore 4 and at least one hydraulic fluid gallery 6. Although only one hydraulic fluid gallery 6 is shown in FIG. 1, one of ordinary skill would recognize a plurality of hydraulic fluid galleries 6 can be provided. The hydraulic lash adjuster arrangement 1 includes a hydraulic lash adjuster assembly 8 including a housing 10 positioned in the bore 4 of the cylinder head 2. The housing 10 has an annular body 12 that includes at least one port 14 on a radially outer wall of the housing 16. A plunger 18 is arranged within the annular body 12 of the housing 10 and is axially displaceable therein to perform a hydraulic lash adjustment as well as optionally a switching function to provide for a partial or zero lift opening of an associated valve. The port 14 of the housing 10 feeds hydraulic fluid into a chamber 19 of the plunger 18 which directs the hydraulic fluid to an open-ended nose portion 18*a* and actuates a switching function of a rocker arm or finger lever assembly (not shown) between first and second valve lift modes. A significant amount of pressure loss occurs when the hydraulic fluid flows from the hydraulic fluid gallery 6 of the cylinder head 2 to the space defined between the cylinder head 2 and an outer surface of the housing 10, and the chamber 19 of the plunger 18. This pressure loss is increased when the hydraulic fluid gallery 6 of the cylinder head 2 is not aligned with the port 14 of the housing 10.

To maintain the alignment of the port 14 of the housing 10 and the hydraulic fluid gallery 6 of the cylinder head 2, and reduce this pressure loss, a clip 20 is provided radially between housing 10 and the cylinder head 2. In one preferred embodiment, the clip 20 is formed from a polymeric material. In another preferred embodiment, the clip 20 is formed from stamped metal, and in a most preferred embodiment the clip 20 is formed from stamped steel. The clip 20 includes a circular body 22 with at least one first tab 24, 25 extending radially outwardly that engages the hydraulic fluid gallery 6 of the cylinder head 2, and at least one second tab 26 extending radially inwardly that engages the port 14. The tabs 24, 25, 26 are configured so that they only obstruct a small portion of the port 14 and the fluid gallery 6 so that the flow of hydraulic fluid is not significantly affected. Preferably, the area of the tabs 24, 25, 26 is approximately 5-10% or less of an area of the port 14 and the hydraulic fluid gallery 6 openings. The clip 20 prevents the housing 10 from rotating within the bore 4 of the cylinder head 2 and maintains the alignment between the hydraulic fluid gallery 6 of the cylinder head 2 and the port 14 of the housing 10. In one preferred embodiment, the at least one first tab 24, 25 is formed from an elastically deformable material. The at least one first tab 24, 25 is preferably formed from a resilient material such that the tab 24, 25 can bend during insertion of the housing 10 into the bore 4 and any additional positioning of the housing 10 within the bore 4. After installation, the at least one first tab 24, 25 resiliently springs radially outwardly again to engage the hydraulic fluid gallery 6 of the cylinder head 2, and locks the housing 10 rotationally in position within the cylinder head 2.

In one preferred embodiment, the at least one first tab 24, 25 and the at least one second tab 26 are circumferentially aligned with each other on radially opposite faces of the circular body 22 of the clip 20. In another preferred embodiment shown in FIG. 2, the at least one first tab 24 and the at least one second tab 26 are circumferentially offset from each other on radially opposite faces of the circular body 22 of the clip 20. One of ordinary skill recognizes that the at least one first tab 24, 25 and the at least one second tab 26 can be circumferentially spaced apart by any distance, depending on the particular configuration of a hydraulic lash adjuster arrangement.

In the embodiment shown in FIGS. 1 and 2, the clip 20 is arranged in an annular groove 17 on the radially outer wall 16 of the housing 10. The clip 20 can be positioned along any portion of the body 12 of the housing 10 as long as the clip 20 is radially arranged between the housing 10 and the bore 4 of the cylinder head 2. In one preferred embodiment, the clip 20 is elastic and has an inner diameter that is less than the outer diameter of the body 12 of the housing 10. During assembly, the clip 20 elastically deforms to stretch around the outer diameter of the body 12 of the housing 10, and once positioned, the clip 20 maintains its position on the body 12 of the housing 10 due to its elasticity.

In one preferred embodiment, the at least one first tab 24 engages a first portion 6*a* of the hydraulic fluid gallery 6, and the clip 20 includes an additional first tab 25 extending radially outwardly that engages a second portion 6*b* of the hydraulic fluid gallery 6 on an opposite side of the hydraulic fluid gallery 6 from the first portion 6*a*. One of skill in the art recognizes any number or configuration of tabs can be arranged on the clip 20 as long as the tabs provide an engagement portion with the hydraulic fluid gallery 6 or any other portion of the bore 4 of the cylinder head 2.

In one preferred embodiment, the at least one first tab 24, 25 and the at least one second tab 26 have the same dimensions. In one preferred embodiment, the tabs 24, 25, 26 have a width of 2-3 mm and a thickness of 0.1-0.2 mm. One of skill in the art recognizes that any number of shapes and sizes can be used for the at least one first tab 24, 25 and the at least one second tab 26 provided that each tab provides a portion that engages against the hydraulic fluid gallery 6 and the port 14, respectively.

It is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A hydraulic lash adjuster arrangement comprising:

a cylinder head including a bore and at least one hydraulic fluid gallery; and a hydraulic lash adjuster assembly including:

a housing positioned in the bore of the cylinder head including an annular body that includes a port on a radially outer wall of the housing;

a plunger arranged within the housing that is axially displaceable therein; and a clip including a circular body and at least one first tab extending radially outwardly and at least one second tab extending radially inwardly, wherein the at least one first tab engages the at least one hydraulic fluid gallery, and the at least one second tab engages the port.

2. The hydraulic lash adjuster assembly of claim 1, wherein the at least one first tab and the at least one second tab are arranged circumferentially aligned with each other on radially opposite faces of the circular body.

3. The hydraulic lash adjuster assembly of claim 1, wherein the at least one first tab and the at least one second tab are arranged circumferentially offset from each other on radially opposite faces of the circular body.

4. The hydraulic lash adjuster assembly of claim 1, wherein the clip is formed from a polymeric material.

5. The hydraulic lash adjuster assembly of claim 1, wherein the clip is formed from a stamped metal.

6. The hydraulic lash adjuster assembly of claim 1, wherein the clip is formed from a stamped steel.

7. The hydraulic lash adjuster assembly of claim 1, wherein the at least one first tab is formed from an elastically deformable material.

8. The hydraulic lash adjuster assembly of claim 1, wherein the at least one first tab includes two of the first tabs, and one of the first tabs engages a first portion of the at least one hydraulic fluid gallery, and the other of the first tabs engages a second portion of the at least one hydraulic fluid gallery on an opposite side of the at least one hydraulic fluid gallery from the first portion of the at least one hydraulic fluid gallery.

9. The hydraulic lash adjuster assembly of claim 1, wherein the at least one first tab and the at least one second tab have the same dimensions.

10. A hydraulic lash adjuster assembly comprising:

a housing positioned including an annular body that includes a port on a radially outer wall of the housing;

a plunger arranged within the housing that is axially displaceable therein; and a clip including a circular body and at least one first tab extending radially outwardly that engages at least one hydraulic fluid gallery formed on a cylinder head, and at least one second tab extending radially inwardly that engages the port.

11. A hydraulic lash adjuster arrangement comprising:

a cylinder head including a bore and at least one hydraulic fluid gallery; and a hydraulic lash adjuster assembly including:

a housing positioned in the bore of the cylinder head including an annular body that includes a port on a radially outer wall of the housing;

a plunger arranged within the housing that is axially displaceable therein; and a clip including a circular body and at least one first tab extending radially outwardly and at least one second tab extending radially inwardly, wherein the port is located within an annular groove on the radially outer wall of the housing, and the clip is positioned within the annular groove.

12. The hydraulic lash adjuster assembly of claim 11, wherein the at least one first tab and the at least one second tab are arranged circumferentially aligned with each other on radially opposite faces of the circular body.

13. The hydraulic lash adjuster assembly of claim 11, wherein the at least one first tab and the at least one second tab are arranged circumferentially offset from each other on radially opposite faces of the circular body.

14. The hydraulic lash adjuster assembly of claim 11, wherein the clip is formed from a polymeric material.

15. The hydraulic lash adjuster assembly of claim 11, wherein the clip is formed from a stamped metal.

16. The hydraulic lash adjuster assembly of claim 11, wherein the clip is formed from a stamped steel.

17. The hydraulic lash adjuster assembly of claim 11, wherein the at least one first tab is formed from an elastically deformable material.

18. The hydraulic lash adjuster assembly of claim 11, wherein the at least one first tab and the at least one second tab have the same dimensions.

19. The hydraulic lash adjuster assembly of claim 11, wherein the at least one first tab includes two of the first tabs, and one of the first tabs engages a first portion of the at least one hydraulic fluid gallery, and the other of the first tabs engages a second portion of the at least one hydraulic fluid gallery on an opposite side of the at least one hydraulic fluid gallery from the first portion of the at least one hydraulic fluid gallery.

* * * * *